US012653237B2

(12) United States Patent
Wen et al.

(10) Patent No.: US 12,653,237 B2
(45) Date of Patent: Jun. 16, 2026

(54) AEROSOL FLAVOR ADJUSTING DEVICE AND VAPORIZATION DEVICE

(71) Applicant: SHENZHEN SMOORE TECHNOLOGY LIMITED, Shenzhen (CN)

(72) Inventors: Zhihua Wen, Shenzhen (CN); Houlin Chen, Shenzhen (CN); Fenglei Xing, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 573 days.

(21) Appl. No.: 18/090,208

(22) Filed: Dec. 28, 2022

(65) Prior Publication Data

US 2023/0210180 A1 Jul. 6, 2023

(30) Foreign Application Priority Data

Dec. 31, 2021 (CN) ..... 202111678771.2

(51) Int. Cl.
*A24F 40/46* (2020.01)
*A24F 40/70* (2020.01)

(52) U.S. Cl.
CPC ..... *A24F 40/46* (2020.01); *A24F 40/70* (2020.01)

(58) Field of Classification Search
CPC ..... A24F 40/10; A24F 40/42; A24F 40/485; A24F 40/30; A24F 40/40; A24F 40/60;
(Continued)

(56) References Cited

U.S. PATENT DOCUMENTS

2010/0126505 A1* 5/2010 Rinker ..... A24F 42/60 128/202.21
2016/0198771 A1* 7/2016 Goggin ..... H05B 3/44 131/329

(Continued)

FOREIGN PATENT DOCUMENTS

CN 207639673 U 7/2018
CN 212590266 U 2/2021

(Continued)

OTHER PUBLICATIONS

European Patent Office, Search Report in European Patent Application No. 22213024.7 (May 22, 2023).

(Continued)

*Primary Examiner* — Michael H. Wilson
*Assistant Examiner* — Stephanie Lynn Moore
(74) *Attorney, Agent, or Firm* — Leydig, Voit & Mayer, Ltd.

(57) ABSTRACT

An aerosol flavor adjusting device for an electronic vaporization device having a vaporizer, comprises a housing and a vent tube arranged in the housing. The vent tube is configured to receive a first portion of a first aerosol from the vaporizer. The vent tube and the housing form an accommodating cavity therebetween. The accommodating cavity is configured to accommodate a flavor adjusting substrate and release a second aerosol. One or more first circulation holes are provided on a side wall of the vent tube and configured to pass at least part of the first portion of the first aerosol from the vent tube to the accommodating cavity. The first portion of the first aerosol is mixed with an effective substance of the flavor adjusting substrate in the accommodating cavity to form a first portion of the second aerosol.

20 Claims, 6 Drawing Sheets

(58) Field of Classification Search
CPC .. A61M 15/06; A61M 15/0003; A24B 15/167
See application file for complete search history.

(56) References Cited

U.S. PATENT DOCUMENTS

| | | | | |
|---|---|---|---|---|
| 2017/0196269 | A1* | 7/2017 | Bernauer | A24F 40/40 |
| 2017/0265517 | A1* | 9/2017 | Swede | B01J 13/22 |
| 2018/0169357 | A1 | 6/2018 | Reevell | |
| 2019/0289909 | A1 | 9/2019 | Hejazi | |
| 2020/0352256 | A1 | 11/2020 | Hejazi et al. | |

FOREIGN PATENT DOCUMENTS

| | | | |
|---|---|---|---|
| EP | 3245885 | A1 | 11/2017 |
| WO | 2014116974 | A1 | 7/2014 |
| WO | 2020205826 | A1 | 10/2020 |
| WO | 2021053023 | A1 | 3/2021 |
| WO | 2021053024 | A1 | 3/2021 |

OTHER PUBLICATIONS

Japanese Patent Office, Notice of Reasons for Refusal in Japanese Patent Application No. 2022-175441 (Jan. 16, 2024).

* cited by examiner

AEROSOL FLAVOR ADJUSTING DEVICE AND VAPORIZATION DEVICE

CROSS-REFERENCE TO RELATED APPLICATION

This application claims the benefit of priority to Chinese Patent Application No. 202111678771.2, filed on Dec. 31, 2021, the entire disclosure of which is incorporated by reference herein.

TECHNICAL FIELD

The present disclosure relates to the field of vaporization, and more specifically, to an aerosol flavor adjusting device and a vaporization device.

BACKGROUND

There is an electronic vaporization device with mixing flavors in the related art. The electronic vaporization device generally includes a vaporizer and a flavor adjusting device. A first aerosol generated by the vaporizer enters the flavor adjusting device, a temperature of the first aerosol is configured to heat a flavor adjusting substrate in the flavor adjusting device, and an effective substance brought out of the flavor adjusting substrate forms a second aerosol for a user to inhale. The electronic vaporization device can include a plurality of flavors, but the vaporization manner has the problems of small release amount of effective substances and inconsistent release amount of effective substances, resulting in poor taste.

There is another secondary heating and vaporization manner. In addition to being heated by the first aerosol to bring out the effective substance, the flavor adjusting substrate is additionally heated, that is, the flavor adjusting substrate is heated twice. The manner can increase the release amount of effective substances to a certain extent, but there is still a problem of inconsistent effective substances leading to poor taste.

SUMMARY

The technical problem to be resolved by the present disclosure is to provide an aerosol flavor adjusting device and a vaporization device in view of the foregoing defects in the related art.

On the one hand, an embodiment of the present disclosure provides an aerosol flavor adjusting device, where the aerosol flavor adjusting device is applied to an electronic vaporization device mounted with a vaporizer, to perform flavor adjustment on a first aerosol formed by the vaporizer to form a second aerosol, where the aerosol flavor adjusting device includes a housing and a vent tube that is arranged in the housing, an accommodating cavity is formed between the housing and the vent tube, and the accommodating cavity is configured to accommodate a flavor adjusting substrate.

And first circulation holes are provided on a side wall of the vent tube, so that after entering the vent tube, the first aerosol enters the accommodating cavity through the first circulation holes and is mixed with an effective substance of the flavor adjusting substrate to form the second aerosol and flows out.

In an embodiment, two ends of the accommodating cavity are respectively provided with an inlet and an outlet that are configured to allow an aerosol to enter and flow out, at least part of the first aerosol enters the accommodating cavity from the inlet, and at least part of the second aerosol flows out from the outlet.

In an embodiment, an end portion of the vent tube that corresponds to the outlet is closed, and the second aerosol flows out from a position on the outlet other than the end portion of the vent tube.

In an embodiment, the end portion of the vent tube that corresponds to the outlet is pointed. In an optional implementation, the end portion of the vent tube that corresponds to the outlet is provided with a second circulation hole, and the aerosol-generating substrate covers the second circulation hole at the end portion of the vent tube.

In an embodiment, the first circulation holes on the side wall of the vent tube are arranged from sparse to dense in a direction toward the outlet.

In an embodiment, pore sizes of the first circulation holes on the side wall of the vent tube are distributed from small to large toward in a direction toward the outlet.

In an embodiment, the first circulation holes on the side wall of the vent tube are provided axially symmetrically or centrally symmetrically.

In an embodiment, the housing and the vent tube are an integral structure. In an embodiment, there are a plurality of the vent tubes.

In an embodiment, a heating device is arranged on an outer side of the housing, and the heating device is configured to heat the aerosol-generating substrate accommodated in the accommodating cavity to cause the aerosol-generating substrate to release an effective substance.

In an embodiment, the heating device is a heating ring sleeved on the outer side of the housing.

In an embodiment, the heating device is an electromagnetic coil sleeved outside the housing.

In an embodiment, the heating device is a heating film arranged on the outer side the housing, or the heating device is an FPC arranged around the housing.

In an embodiment, the heating device is an infrared heating device.

On the other hand, an embodiment of the present disclosure provides an electronic vaporization device, including a vaporizer, and the aerosol flavor adjusting device. A first aerosol formed by the vaporizer vaporizing an aerosol-generating substrate at least partially enters the aerosol flavor adjusting device to form a second aerosol for a user to inhale.

In the aerosol flavor adjusting device and the vaporization device provided in this embodiment of the present disclosure, a porous vent component is arranged in the aerosol flavor adjusting device, and a part of the first aerosol vaporized by the vaporizer directly enters the accommodating cavity from a bottom portion of the aerosol flavor adjusting device, and an other part of the first aerosol vaporized by the vaporizer enters the accommodating cavity through the porous vent component. The two parts of the first aerosol are mixed with the effective substance in the aerosol flavor adjusting device to form a second aerosol and then enter the mouth of the user. The two parts of the first aerosol are more fully mixed, which is conducive to the release of the effective substance in the aerosol-generating substrate in the accommodating cavity, increasing the total release amount of effective substances, and making the taste soft and more coordinated, so that problems of serious attenuation of the effective substance and poor taste are improved.

BRIEF DESCRIPTION OF THE DRAWINGS

The present disclosure is further described below with reference to the accompanying drawings and embodiments, and in the accompanying drawings.

DETAILED DESCRIPTION

Figure 1:
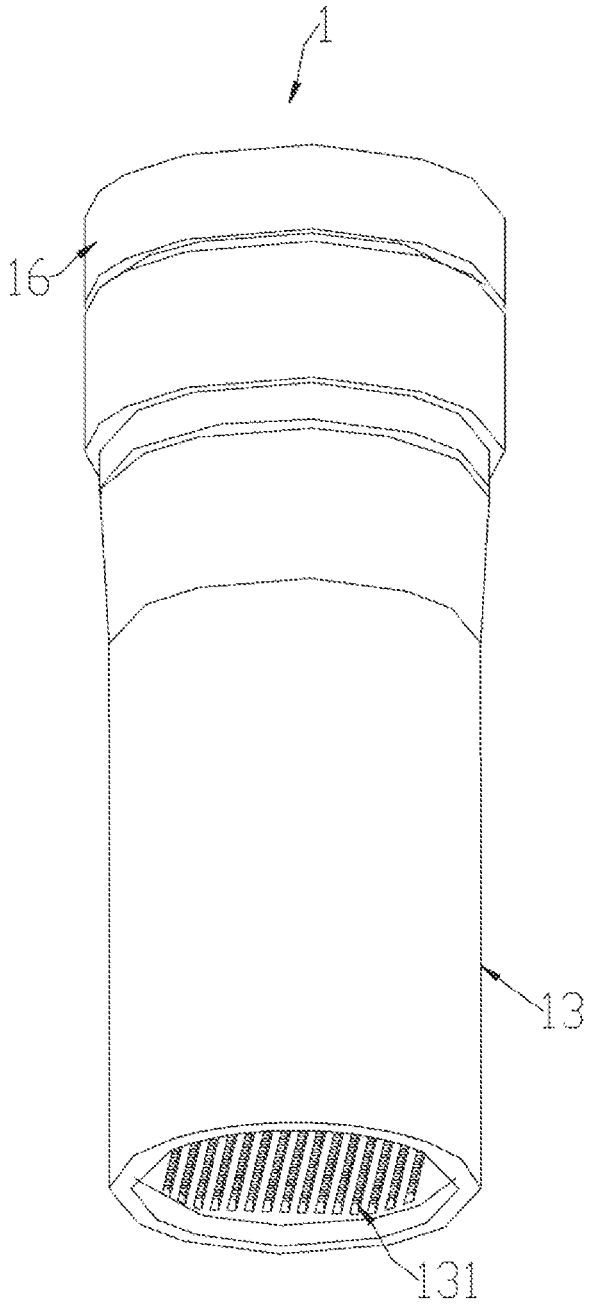
FIG. 1 is a schematic diagram of a three-dimensional structure of an aerosol flavor adjusting device according to an embodiment of the present disclosure.

To provide a clearer understanding of the technical features, objectives, and effects of the present disclosure, specific implementations of the present disclosure are described with reference to the accompanying drawings.

In the description of the present disclosure, it should be understood that, orientations or position relationships indicated by terms such as "center", "longitudinal", "transverse", "length", "width", "thickness", "up", "down", "front", "rear", "left", "right", "vertical", "horizontal"; "top", "bottom", "inner", "outer", "clockwise", "counterclockwise", "axial", "radial", and "circumferential" are orientations or position relationship shown based on the accompanying drawings, and are merely used for describing the present disclosure and simplifying the description, rather than indicating or implying that the apparatus or element should have a particular orientation or be constructed and operated in a particular orientation, and therefore, should not be construed as a limitation on the present disclosure.

In addition, the terms "first" and "second" are used merely for the purpose of description, and shall not be construed as indicating or implying relative importance or implying a quantity of indicated technical features. Therefore, features defining "first" and "second" can explicitly or implicitly include at least one of the features. In the description of the present disclosure, unless otherwise explicitly and specifically defined, "a plurality of" means at least two, for example, two, three and the like.

In the present disclosure, it should be noted that unless otherwise clearly specified and limited, the terms "mounted", "connected", "connection", and "fixed" should be understood in a broad sense. For example, a connection may be a fixed connection, a detachable connection, or an integral connection; may be a mechanical connection or an electrical connection; may be a direct connection or an indirect connection by means of an intermediate medium; or may be internal communication between two elements or interaction relationship between two elements, unless otherwise clearly limited. Persons of ordinary skill in the art may understand the specific meanings of the foregoing terms in the present disclosure according to specific situations.

In the present disclosure, unless explicitly specified or limited otherwise, a first characteristic "on" or "under" a second characteristic may be the first characteristic in direct contact with the second characteristic, or the first characteristic in indirect contact with the second characteristic by using an intermediate medium. In addition, the first feature being located "above" the second feature may be the first feature being located directly above or obliquely above the second feature, or may simply indicate that the first feature is higher in level than the second feature. The first feature "under", "below" and "down" the second feature may be that the first feature is directly below or obliquely below the second feature, or simply indicates that a horizontal height of the first feature is less than that of the second feature.

It should be noted that, when a component is referred to as "being fixed to" or "being arranged on" another component, the component may be directly on the another component, or there may be an intermediate component. When a component is considered to be "connected to" another component, the component may be directly connected to the another component, or an intervening component may also be present. The terms "vertical", "horizontal", "upper", "lower", "left", "right", and similar expressions used in this specification are merely used for an illustrative purpose, and do not represent the only implementation.

The electronic vaporization device provided in this disclosure heats an aerosol-generating substrate to generate an aerosol for the user to use. A form of the aerosol-generating substrate may be liquid, gel, paste, or solid. When the aerosol-generating substrate is a solid, the aerosol-generating substrate may be a pulverized solid, a granular solid, a powdered solid, a granulated solid, a bar solid, or a flake solid. The aerosol-generating substrate includes, but is not limited to, a material used for purposes such as medical treatment, health-preserving, health, and beauty. For example, the aerosol-generating substrate may be a liquid medicine or oil, or the aerosol-generating substrate may be a plant material, such as roots, stems, leaves, flowers, buds, or seeds of a plant.

In the flavor adjusting device provided in this embodiment of the present disclosure, the form of the flavor adjusting substrate may be liquid, gel, paste, or solid. When the flavor adjusting substrate is a solid, the aerosol-generating substrate may be a pulverized solid, a granular solid, a powdered solid, a granulated solid, a bar solid, or a flake solid. The flavor adjusting substrate includes, but is not limited to, a material used for purposes such as medical treatment, health-preserving, health, and beauty. For example, the flavor adjusting substrate is liquid medicine or oil, or the flavor adjusting substrate is a plant material, such as roots, stems, leaves, flowers, buds, or seeds of a plant.

Figure 2:
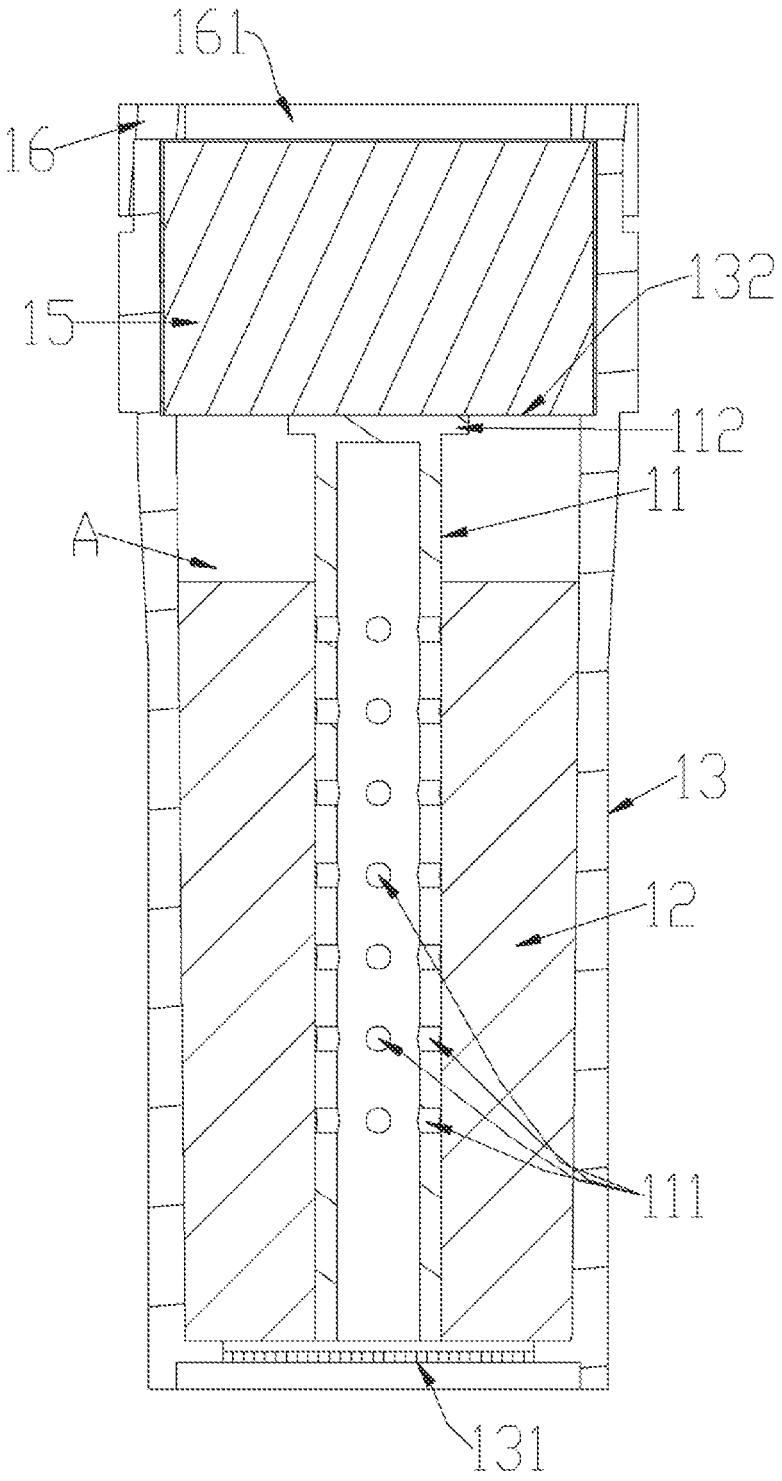
FIG. 2 is a schematic diagram of a cross-sectional structure of the aerosol flavor adjusting device in FIG. 1.

As shown in FIG. 1 and FIG. 2, an aerosol flavor adjusting device 1 is provided according to an embodiment of the present disclosure.

The aerosol flavor adjusting device 1 is applied to an electronic vaporization device mounted with a vaporizer, to perform flavor adjustment on a first aerosol formed by the vaporizer to form a second aerosol. The aerosol flavor adjusting device 1 includes a housing 13 and a vent tube 11 that is arranged in the housing 13. An accommodating cavity A is formed between the housing 13 and the vent tube 11, and the accommodating cavity A is configured to accommodate a flavor adjusting substrate 12; and first circulation holes 111 are provided on a side wall of the vent tube 11, so that after entering the vent tube 11, the vaporized first aerosol enters the accommodating cavity A through the first circulation holes 111 and is mixed with an effective substance of the aerosol-generating substrate 12 to form a second aerosol and flows out. In the accommodating cavity A, the flavor adjusting substrate 12 of different types and flavors can be placed according to user requirements.

A porous vent component is arranged in the middle of aerosol flavor adjusting device 1, and a part of the first aerosol vaporized by the vaporizer directly enters a flavor cartridge from a bottom portion of the aerosol flavor adjusting device 1, and another part of the first aerosol vaporized by the vaporizer enters the flavor cartridge through the porous vent component. The two parts of the first aerosol are mixed to form a second aerosol and then enter the mouth of the user, so that the effective substance is released more fully, the taste is made soft and more coordinated, and problems of serious attenuation of the effective substance and poor taste are improved.

In an embodiment, there are a plurality of the vent tubes 11, which are evenly arranged in the housing 13. In this way, the effective substance in the aerosol-generating substrate 12 can be better released, so that the formed second aerosol has better consistency and better taste.

Two ends of the accommodating cavity A are respectively provided with an inlet 131 for the aerosol of the vaporizer to enter, and an outlet 132 of which the aerosol flows out after entering. Optionally, the inlet has a mesh structure to allow the aerosol to pass through evenly.

A part of the first aerosol of the vaporizer enters the accommodating cavity A through the inlet 131, and a part of the first aerosol of the vaporizer enters the vent tube 11. The first aerosol in the vent tube 11 flows into the accommodating cavity A through the first circulation holes 111. The two parts of the first aerosol of the vaporizer are respectively mixed with the effective substance in the flavor adjusting substrate 12 to form a second aerosol and flows out of the outlet 132.

In an embodiment, an end portion of the vent tube 11 that corresponds to the outlet 132 is closed, and the second aerosol flows out from a position on the outlet 132 other than the end portion of the vent tube 11. Through this arrangement, the first aerosol entering the vent tube 11 can better enter the accommodating cavity A, and more effectively mix with the effective substance of the aerosol-generating substrate in the accommodating cavity, so that the taste of the formed second aerosol is better.

In an embodiment, the end portion of the vent tube 11 that corresponds to the outlet 132 is pointed. In this way, the vent tube 11 is more convenient to be produced and assembled.

In an embodiment, an end portion of the vent tube 11 that corresponds to the outlet 132 is provided with a second circulation hole 113, and the aerosol-generating substrate 12 covers the second circulation hole 113 at the end portion of the vent tube 11. That is, a length of the vent tube 11 is less than a length of the housing 13, so that the formed second aerosol can be stirred and mixed under the action of different air pressures before flowing out of the outlet 132.

In an embodiment, a circulation speed of the first aerosol in the vent tube 11 is sequentially slowed down, and density is sequentially decreased. To cause the aerosol entering the accommodating cavity A in each section of the vent tube 11 to be more even, the first circulation holes 111 on the side wall of the vent tube 11 are arranged from sparse to dense in the direction of the outlet 132. In this way, a speed of the first aerosol just entering the vent tube 11 is relatively high, the first aerosol continues to flow in the vent tube 11 from an area with a small quantity of first circulation holes 111 into the accommodating cavity A, and both the speed and density are decreased. To allow more first aerosols to enter the accommodating cavity A in a rear section, the quantity of the first circulation holes 111 can be gradually increased to ensure that the amount of the first aerosol entering the accommodating cavity A in each section of the vent tube 111 is more even.

In addition, to cause the aerosol entering the accommodating cavity A in each section of the vent tube 11 to be more even, pore sizes of the first circulation holes 111 on the side wall of the vent tube 11 can also be distributed from small to large in the direction of the outlet 132.

In this way, a speed of the first aerosol just entering the vent tube 11 is relatively high, the first aerosol enters the accommodating cavity A from an area with small pore sizes of the first circulation holes 111, and the amount of aerosol entering the accommodating cavity A is controlled. The first aerosol continues to flow in the vent tube 11, and both the speed and density are decreased. To allow more first aerosols to enter the accommodating cavity A in a rear section, the pore sizes of the first circulation holes 111 can be gradually increased to ensure that the amount of the first aerosol entering the accommodating cavity A in each section of the vent tube 111 is more even.

In an embodiment, the first circulation holes 111 on the side wall of the vent tube 11 are provided axially symmetrically or centrally symmetrically, so that the first aerosol can enter the accommodating cavity A more evenly from the first circulation holes 111 in a circumferential direction, and is fully stirred and mixed with the effective substance released, by the aerosol-generating substrate 12 in the accommodating cavity A.

In an embodiment, an outer ring of the end portion of the vent tube 11 that is arranged at the first circulation hole 111 is provided with a flanging 112. When the aerosol-generating substrate 12 is mounted at a position of the flanging 112, the aerosol-generating substrate 12 can be pressed and positioned. It is also convenient for the flanging 112 to receive a force when the vent tube 11 is taken out, and it is convenient to take out the vent tube 11. The flanging 112 can further increase a contact surface with a filter 15, so that the positioning of the vent tube 11 is more stable.

Figure 3:
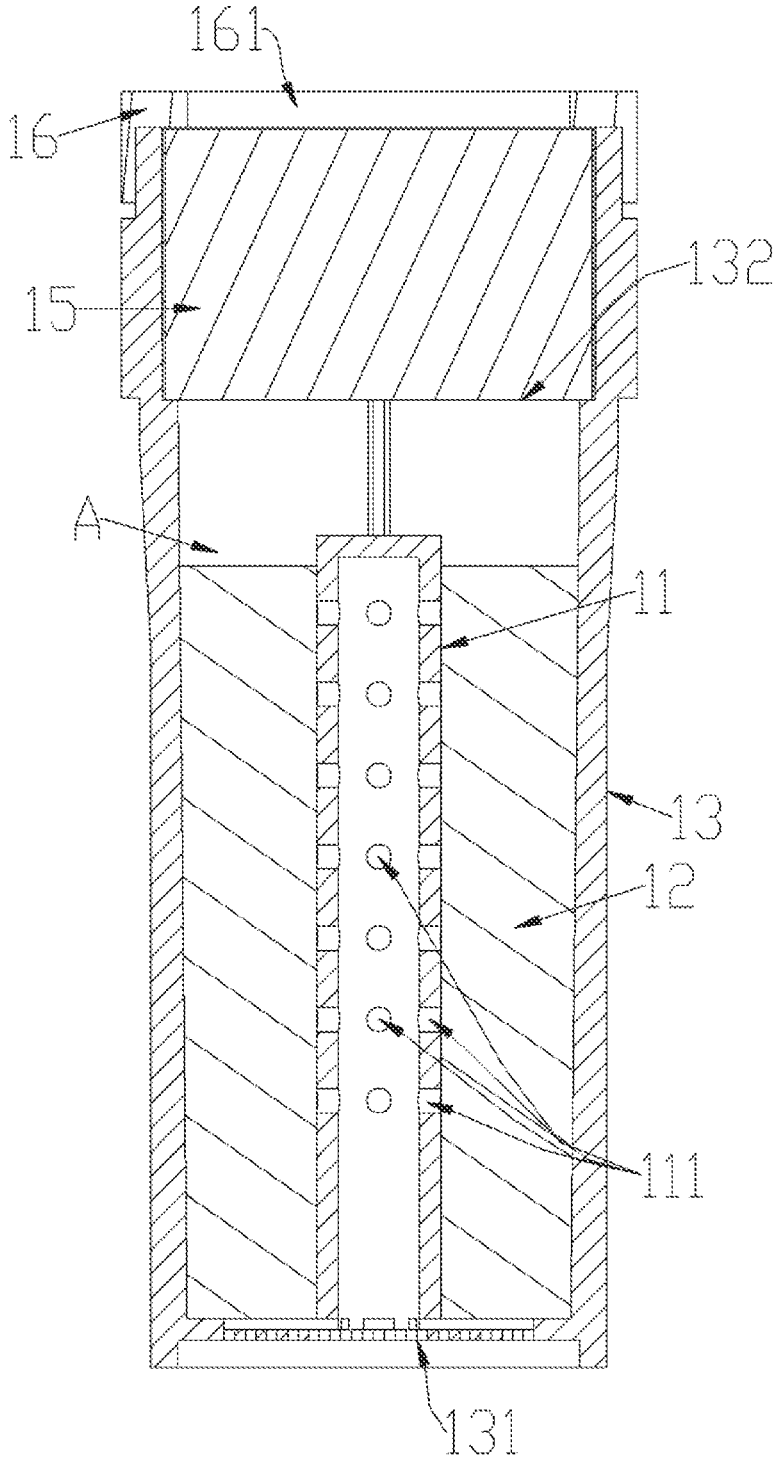
FIG. 3 is a schematic diagram of a cross-sectional structure when a housing and a vent tube of the aerosol flavor adjusting device in FIG. 1 are integrated.
Figure 4:
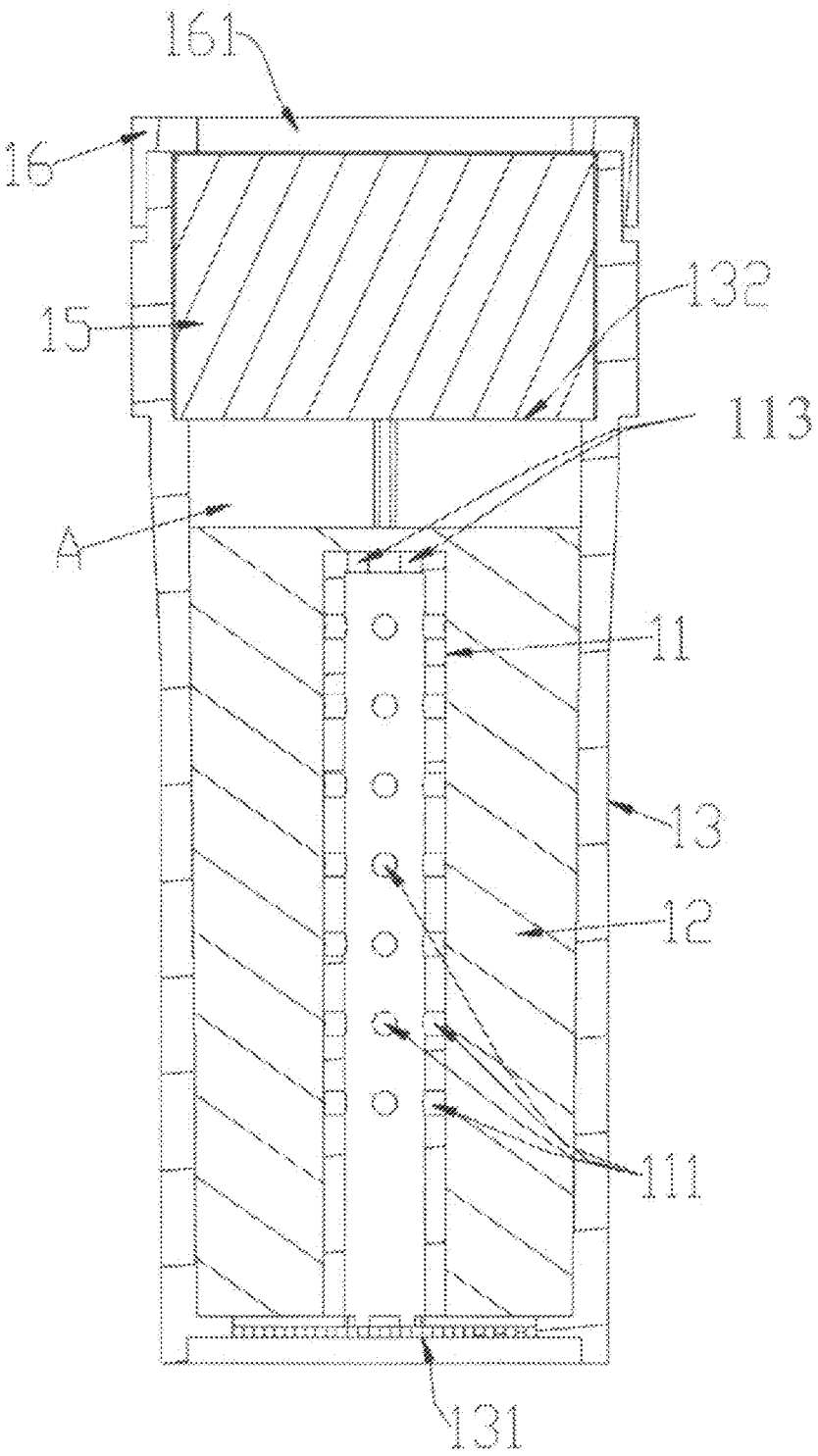
FIG. 4 is a schematic diagram of a cross-sectional structure when an end portion of a vent tube that corresponds to an outlet of the aerosol flavor adjusting device in FIG. 1 is provided with a first circulation hole.

As shown in FIG. 3, in the second embodiment, the vaporization device includes a vaporizer and an aerosol flavor adjusting device 1. The vaporizer is provided with an exhaust opening, and the first aerosol generated after the vaporizer vaporizes the aerosol-generating substrate 12 enters the vent tube 11 of a multi-air dynamic stirring device through the exhaust opening.

The aerosol flavor adjusting device 1 includes a vent tube 11 and an aerosol-generating substrate 12 arranged outside the vent tube 11. First circulation holes 111 are provided on a side wall of the vent tube 11, so that after entering the vent tube 11, the vaporized first aerosol then enters the outside of the vent tube 11 through the first circulation holes 111 and is mixed with the first aerosol entering the aerosol-generating substrate 12 from the outside of the vent tube 11 to form a second aerosol and flows out after heating the aerosol-generating substrate 12.

In an embodiment, a plurality of first circulation holes 111 are distributed on the side wall of the vent tube 11. Further, a circulation speed of the aerosol in the vent tube 11 is sequentially slowed down, and density is sequentially decreased, To cause the first aerosol entering the accommodating cavity A in each section of the vent tube 11 to be more even, the first circulation holes 111 on the side wall of the vent tube 11 are arranged from sparse to dense in the direction of the outlet 132. In this way, a speed of the aerosol just entering the vent tube 11 is relatively high, the first aerosol continues to flow in the vent tube 11 from an area with a small quantity of first circulation holes 111 into the accommodating cavity A, and both the speed and density are decreased. To allow more aerosols to enter the accommodating cavity A in a rear section, the quantity of the first circulation holes 111 can be gradually increased to ensure that the amount of the first aerosol entering the accommodating cavity A in each section of the vent tube 111 is more even.

In an embodiment, to cause the aerosol entering the accommodating cavity A in each section of the vent tube 11 to be more even, pore sizes of the first circulation holes 111 on the side wall of the vent tube 11 can also be distributed from small to large in the direction of the outlet 132. In this way, a speed of the first aerosol just entering the vent tube 11 is relatively high, the first aerosol enters the accommodating cavity A from an area with small pore sizes of the first circulation holes 111, and the amount of the first aerosol entering the accommodating cavity A is controlled. The first aerosol continues to flow in the vent tube 11, and both the speed and density are decreased. To allow more first aerosols to enter the accommodating cavity A in a rear section, the pore sizes of the first circulation holes 111 can be gradually increased to ensure that the amount of the first aerosol entering the accommodating cavity A in each section of the vent tube 111 is more even.

In an embodiment, the first circulation holes 111 on the side wall of the vent tube 11 are provided axially symmetrically or centrally symmetrically, so that the aerosol can enter the accommodating cavity A more evenly from the first circulation hole 111 in a circumferential direction, and is fully stirred and mixed with the effective substance released by the aerosol-generating substrate 12 in the accommodating cavity A to form the second aerosol.

In an embodiment, compared with the first embodiment, the housing 13 and the vent tube 11 are an integral structure, which saves assembly steps. In addition, the surface of the outer ring of the vent tube 11 is flat, and the outer ring of the end portion that corresponds to the first circulation hole 111 is not provided with a protrusion, which is convenient for filling the aerosol-generating substrate 12 inward and taking out the aerosol-generating substrate 12 inside.

In an embodiment, the end portion of the vent tube 11 that corresponds to the outlet 132 is closed, so that the aerosol entering the vent tube 11 flows out from the first circulation holes 111 on the side wall.

The porous component structure provided in this embodiment of the present disclosure allows the aerosol to pass through the first circulation hole 111, and to be stirred and mixed with the effective substance released by the aerosol-generating substrate 12 such as tobacco, so that the effective substance of the aerosol is more fully mixed, which is conducive to the aerosol to carry the effective substance, increase the total release amount of effective substances, cause the taste to be soft and better coordinated, and improve the problems of serious attenuation of the effective substance and poor taste.

Figure 5:
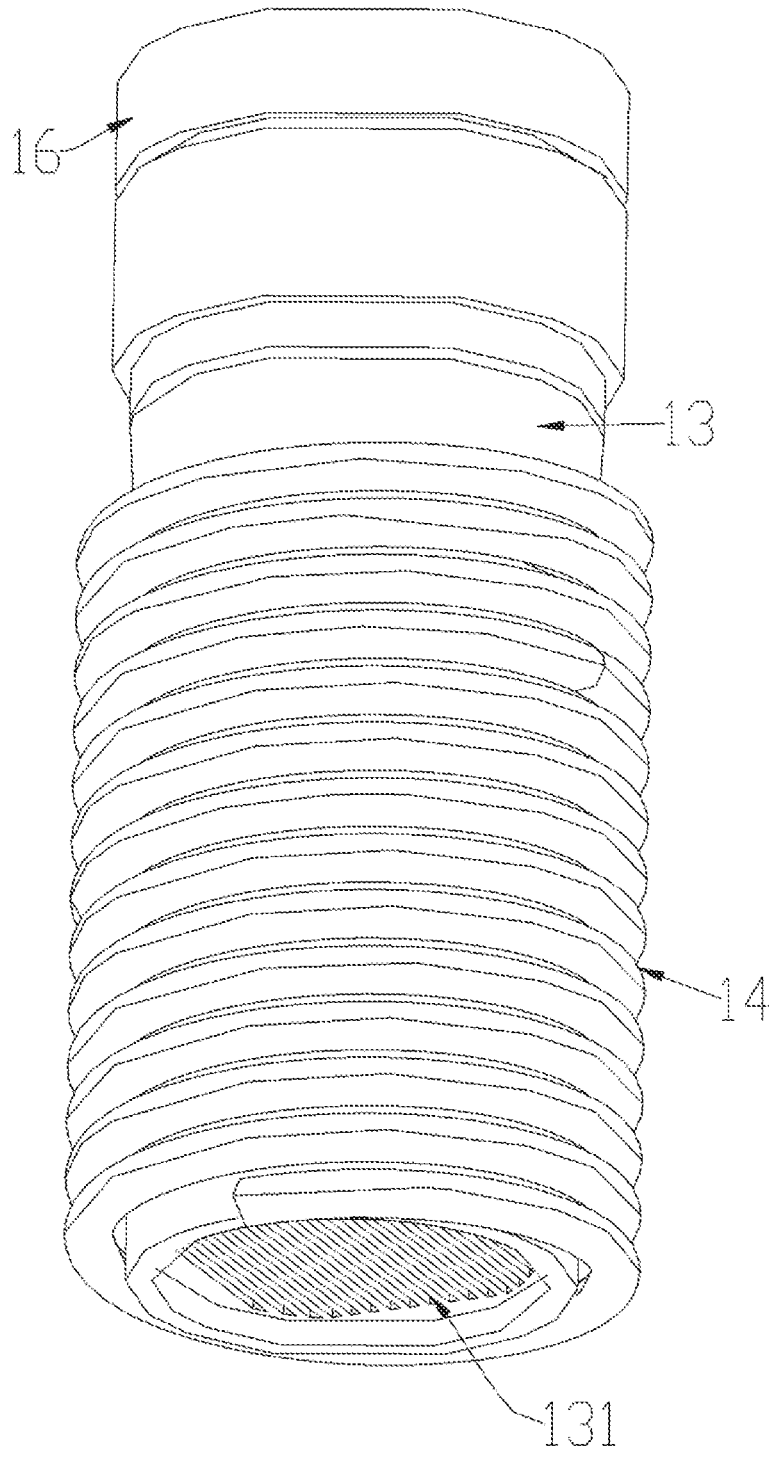
FIG. 5 is a schematic diagram of a cross-sectional structure when a heating device is arranged on an outer side of the aerosol flavor adjusting device in FIG. 1.
Figure 6:
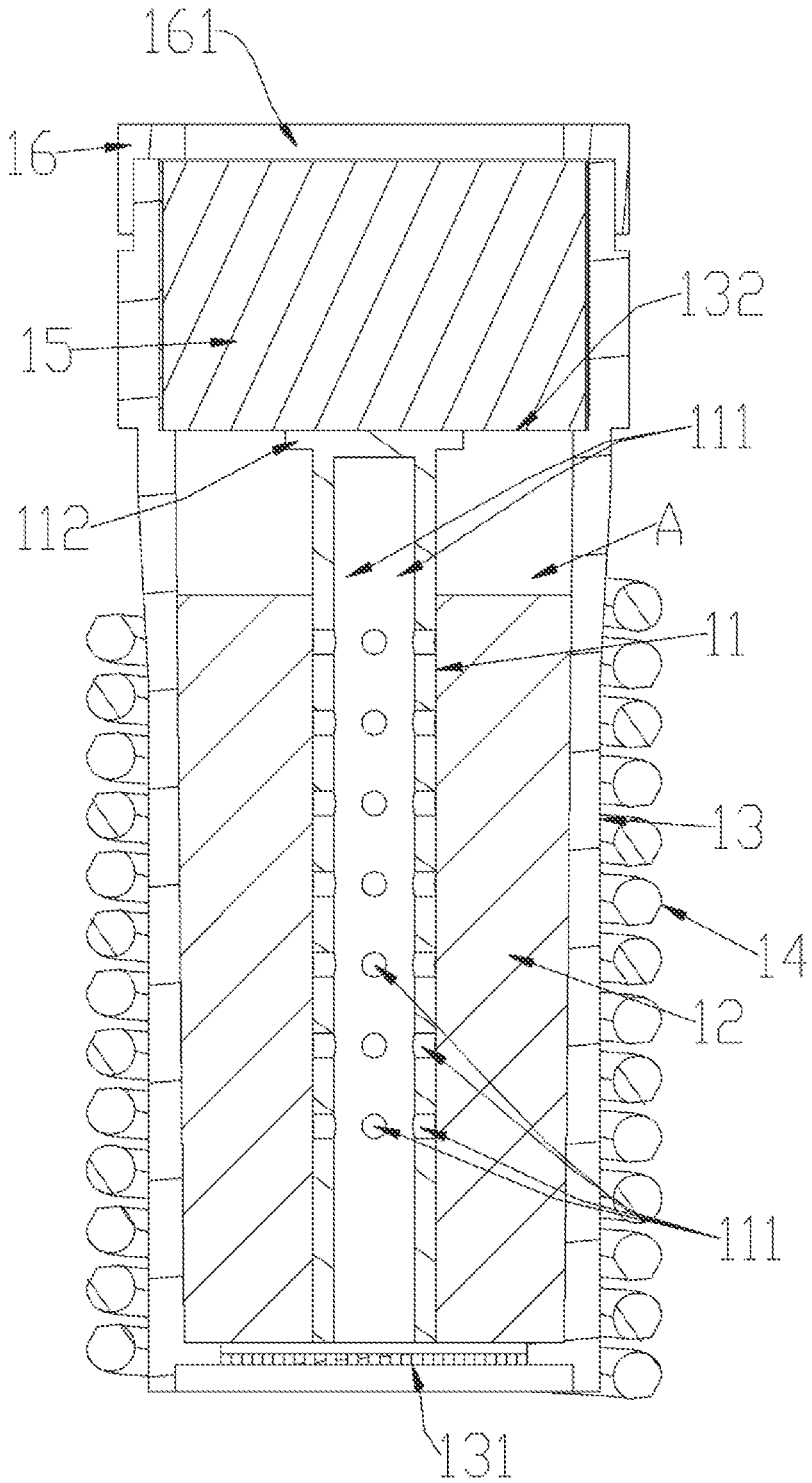
FIG. 6 is a schematic diagram of a cross-sectional structure of the aerosol flavor adjusting device in FIG. 5.

As shown in FIG. 5 and FIG. 6, further in the fourth embodiment, a heating device 14 may be arranged on the outer side of the housing 13 based on the first embodiment, the second embodiment, and the third embodiment. By cooperating with the heating of an outer ring, temperatures of particles of the aerosol-generating substrate 12 and the flavor cartridge are increased, and a temperature difference on a path of the aerosol is reduced. In this way, condensation is reduced and condensate is reduced, which is conducive to the release of the effective substance of the particles of the aerosol-generating substrate 12, and the problem of uneven release in a front section and a rear section of inhaling is improved. In this way, a heat conduction distance of the particles of the aerosol-generating substrate 12 is shortened, and the effective substance in the aerosol-generating substrate 12 is more fully released, so that the formed second aerosol has a better taste.

In the fourth embodiment, the heating device 14 can be a heating ring sleeved on the outer side of the housing 13, and the heating ring generates heat after being energized, and heats the aerosol-generating substrate 12 inside.

In the fourth embodiment, the heating device 14 can also be an electromagnetic coil sleeved outside the housing 13, and after the electromagnetic coil is energized, heat is generated to heat the aerosol-generating substrate 12 inside.

In the fourth embodiment, the heating device 14 may further include a resistive heating body, and the resistive heating body may adopt a manner of being wound in a coil, or adopt a manner of fully coating around the outside of the housing 13.

Further, the housing 13 is made of metal, and the resistive heating body includes an FPC coated outside the housing 13. After the FPC is energized, heat is generated to heat the aerosol-generating substrate 12 inside; or the resistive heating body can also include a thick film heating body coated outside the housing 13. After the heating film is energized, heat is generated to heat the aerosol-generating substrate 12 inside; or the resistive heating body includes a metal heating body coated outside the housing 13, and the FPC, the thick film heating body, and the metal heating body generate heat after being energized.

Further, in the fourth embodiment, the heating device 14 includes an infrared heating body arranged outside the housing 13. Further, correspondingly, the housing 13 is a quartz glass tube, and the infrared heating body includes infrared heating slurry coated outside the quartz glass tube. Under the radiation of infrared light, the infrared heating body generates heat and heats the aerosol-generating substrate 12 inside. Alternatively, the housing 13 is a metal tube, and the infrared heating body includes the infrared heating slurry coated inside the metal tube, and the thick film heating body arranged outside the metal tube. Under the radiation of infrared light, the infrared heating slurry generates heat and transfers heat to the outside through the housing 13 and the thick film heating body, and heats the aerosol-generating substrate 12 inside.

The aerosol-generating substrate 12 in the aerosol flavor adjusting device is heated by arranging the heating device, so that the effective substance in the aerosol-generating substrate 12 is further released to form a second aerosol with more effective substances and better taste.

An embodiment of the present disclosure provides an electronic vaporization device. The electronic vaporization device includes a vaporizer, and the aerosol flavor adjusting device. A first aerosol formed by the vaporizer vaporizing an aerosol-generating substrate at least partially enters the aerosol flavor adjusting device to form a second aerosol for a user to inhale.

When in use, the inlet 131 of the aerosol flavor adjusting device 1 is correspondingly connected and assembled with the vaporizer (not shown in the figure). The vaporizer is provided with an exhaust opening, and the aerosol generated after the vaporizer vaporizes the aerosol-generating substrate 12 enters the vent tube 11 of the aerosol flavor adjusting device through the exhaust opening.

A porous vent component is arranged in the middle of aerosol flavor adjusting device 1, and a part of the first aerosol vaporized by the vaporizer directly enters a flavor cartridge from a bottom portion of the aerosol flavor adjusting device 1, and an other part of the first aerosol vaporized by the vaporizer enters the flavor cartridge through the porous vent component. The two parts of the first aerosol are mixed to form a second aerosol and then enter the mouth of the user.

For the aerosol flavor adjusting device 1 in this embodiment of the electronic vaporization device, reference is made to the aerosol flavor adjusting device 1, and details are not repeated herein again.

Through the porous component structure of the aerosol flavor adjusting device 1, the first aerosol generated by the vaporizer passes through the first circulation holes 111, and is stirred and mixed with the effective substance released by the aerosol-generating substrate 12 in the aerosol flavor adjusting device 1, so that the formed second aerosol carries more effective substances, the total release amount of effective substances is increased, the taste is soft and better coordinated, and the problems of serious attenuation of the effective substance and poor taste are improved.

It can be understood that, provided that the flavor adjusting device provided in this embodiment of the present disclosure outputs a second aerosol with a flavor different from a flavor of the first aerosol, that is, the flavor adjusting device is considered to perform a flavor adjustment, for example, a change in concentration, a change in composition, or any other change that causes the user to feel different. It can be understood that the effective substances described in this embodiment of the present disclosure include any substance that cause the second aerosol to have a flavor different from a flavor of the first aerosol, which includes but is not limited to nicotine, propylene glycol, aromatic compounds, terpenes, or the like.

It can be understood that the foregoing technical features can be used in any combination without limitation.

The foregoing descriptions are embodiments of the present disclosure, and the protection scope of the present disclosure is not limited thereto. All equivalent structure or process changes made according to the content of this specification and accompanying drawings in the present disclosure or by directly or indirectly applying the present disclosure in other related technical fields shall fall within the protection scope of the present disclosure.

What is claimed is:

1. An aerosol flavor adjusting device for an electronic vaporization device having a vaporizer, comprising:

an inlet configured to receive a first aerosol from the vaporizer;

an outlet configured to flow a second aerosol;

a housing; and at least one vent tube arranged in the housing, the at least one vent tube being configured to receive a first portion of the first aerosol via the inlet, the at least one vent tube including a side wall and an end surface facing the outlet, the at least one vent tube and the housing forming an accommodating cavity therebetween, the accommodating cavity being configured to accommodate a flavor adjusting substrate, wherein a plurality of first circulation holes are provided on the side wall of the at least one vent tube, the plurality of first circulation holes arranged from sparse to dense in a direction toward the outlet, the plurality of first circulation holes being configured to pass at least part of the first portion of the first aerosol from the at least one vent tube to the accommodating cavity, wherein at least one second circulation hole is provided on the end surface of the at least one vent tube that faces the outlet, the at least one second circulation hole being configured to pass an additional part of the first portion of the first aerosol from the at least one vent tube to the accommodating cavity, and wherein the first portion of the first aerosol is mixed with an effective substance from the flavor adjusting substrate in the accommodating cavity to form a first portion of the second aerosol.

2. The aerosol flavor adjusting device of claim 1, wherein the accommodating cavity is configured to receive a second portion of the first aerosol from the vaporizer via the inlet and to release at least part of the second aerosol via the outlet.

3. The aerosol flavor adjusting device of claim 2, wherein an end portion of the at least one vent tube that corresponds to the outlet is closed.

4. The aerosol flavor adjusting device of claim 3, wherein the end portion of the at least one vent tube that corresponds to the outlet is pointed.

5. The aerosol flavor adjusting device of claim 2, wherein the flavor adjusting substrate covers the at least one second circulation hole at the end portion of the at least one vent tube.

6. The aerosol flavor adjusting device of claim 2, wherein the plurality of first circulation holes on the side wall of the at least one vent tube are distributed from small to large toward the outlet.

7. The aerosol flavor adjusting device of claim 1, wherein the plurality of first circulation holes are provided axially symmetrically or centrally symmetrically.

8. The aerosol flavor adjusting device of claim 1, wherein the housing and the at least one vent tube are an integral structure.

9. The aerosol flavor adjusting device of claim 1, wherein the at least one vent tube comprises a plurality of vent tubes.

10. The aerosol flavor adjusting device of claim 1, wherein a heating device is arranged on an outer side of the housing, the heating device being configured to heat the flavor adjusting substrate accommodated in the accommodating cavity so as to cause the flavor adjusting substrate to release the effective substance.

11. The aerosol flavor adjusting device of claim 10, wherein the heating device comprises a heating ring sleeved on the outer side of the housing, or the heating device comprises an electromagnetic coil sleeved outside the housing.

12. The aerosol flavor adjusting device of claim 10, wherein the heating device comprises a heating film arranged on the outer side of the housing.

13. The aerosol flavor adjusting device of claim 10, wherein the heating device comprises an infrared heating device.

14. The aerosol flavor adjusting device of claim 2, wherein the second portion of the first aerosol is mixed with the effective substance of the flavor adjusting substrate in the accommodating cavity so as to form a second portion of the second aerosol.

15. The aerosol flavor adjusting device of claim 14, wherein the accommodating cavity is configured to direct the first portion of the second aerosol and the second portion of the second aerosol to the outlet.

16. An electronic vaporization device, comprising:

a vaporizer; and an aerosol flavor adjusting device having:

an inlet, an outlet opposite the inlet, a housing, and at least one vent tube arranged in the housing, the at least one vent tube being configured to receive a first portion of a first aerosol from the vaporizer via the inlet, the at least one vent tube including a side wall and an end surface facing the outlet, the at least one vent tube and the housing forming an accommodating cavity therebetween, the accommodating cavity being configured to accommodate a flavor adjusting substrate, wherein a plurality of first circulation holes are provided on the side wall of the at least one vent tube, the plurality of first circulation holes arranged from sparse to dense in a direction toward the outlet, the plurality of first circulation holes being configured to pass at least part of the first portion of the first aerosol from the at least one vent tube to the accommodating cavity, wherein at least one second circulation hole is provided on the end surface of the at least one vent tube facing the outlet, the at least one second circulation hole being configured to pass an additional part of the first portion of the first aerosol from the at least one vent tube to the accommodating cavity, and wherein the first portion of the first aerosol is mixed with an effective substance released from the flavor adjusting substrate in the accommodating cavity to form the second aerosol and flows out.

17. The electronic vaporization device of claim 16, wherein the inlet is formed at a first end of the accommodating cavity and configured to receive a second portion of the first aerosol from the vaporizer, and wherein the outlet is formed at a second end of the accommodating cavity and configured to release at least part of the second aerosol.

18. The electronic vaporization device of claim 17, wherein an end portion of the at least one vent tube that corresponds to the outlet is closed, and wherein the second aerosol flows out from a position on the outlet other than the end portion of the at least one vent tube.

19. The electronic vaporization device of claim 17, wherein the second portion of the first aerosol is mixed with the effective substance of the flavor adjusting substrate in the accommodating cavity so as to form a second portion of the second aerosol.

20. The electronic vaporization device of claim 19, wherein the accommodating cavity is configured to direct the first portion of the second aerosol and the second portion of the second aerosol to the outlet.

* * * * *